United States Patent [19]

Ford

[11] Patent Number: 4,724,459

[45] Date of Patent: Feb. 9, 1988

[54] APPARATUS FOR SELECTIVELY RECYCLING USED TONER OR DELIVERING SUCH TONER TO A CONTAINER

[75] Inventor: Timothy J. Ford, Rochester, N.Y.

[73] Assignee: Eastman Kodak Company, Rochester, N.Y.

[21] Appl. No.: 947,078

[22] Filed: Dec. 29, 1986

[51] Int. Cl.[4] ..... G03G 15/01

[52] U.S. Cl. ..... 355/4; 118/652; 355/15

[58] Field of Search ..... 355/4, 15; 118/652; 15/256.53

[56] References Cited

U.S. PATENT DOCUMENTS

| | | | |
|---|---|---|---|
| 3,660,863 | 5/1972 | Gerbasi | 15/256.51 |
| 3,700,328 | 10/1972 | Davidge et al. | 355/15 |
| 4,082,061 | 4/1978 | Fraser | 118/645 |
| 4,325,628 | 4/1982 | Torigai et al. | 118/652 |
| 4,571,071 | 2/1986 | Bothner | 355/15 |

FOREIGN PATENT DOCUMENTS

| | | | |
|---|---|---|---|
| 147375 | 8/1984 | Japan | 355/15 |
| 70467 | 4/1985 | Japan | 355/15 |

OTHER PUBLICATIONS

Article by Dr. J. C. Minor; Kodak Ektaprint 250AFB Duplicator, © 1983.

Research Disclosure "Automatic Toner Recycling Apparatus" No. 17738, Jan. 1979, Caswell et al.

*Primary Examiner*—William H. Beha, Jr.

*Attorney, Agent, or Firm*—G. Herman Childress

[57] ABSTRACT

An electrographic apparatus has a photoconductor on which a latent image is formed, and a development station provides particles of toner to the photoconductor for developing a latent image. After the developed image has been trnsferred to a copy sheet, residual toner particles remaining on the photoconductor are removed at a cleaning station. The removed toner particles are either returned to the development station of the electrographic apparatus for reuse or delivered to a container for disposal. For example, if a development station providing black toner particles to a photoconductor is replaced with a development station containing toner particles of a different color, the residual black toner particles removed at the cleaning station are delivered to the container in order to avoid contamination of colored tone particles in the development station with those black particles remaining on the photoconductor from the operation of the black development station operation.

2 Claims, 2 Drawing Figures

APPARATUS FOR SELECTIVELY RECYCLING USED TONER OR DELIVERING SUCH TONER TO A CONTAINER

BACKGROUND OF THE INVENTION

The present invention relates to electrographic apparatus wherein toner particles removed from a photoconductor during a cleaning operation can be selectively returned to a development station for reuse or delivered to a container for disposal.

During operation of known electrographic apparatus a latent image is formed on a photoconductor, a development station provides particles of toner to the photoconductor for developing the latent image, and after the image is transferred to a copy sheet or the like, a cleaning station removes residual particles of used toner from the photoconductor. In some instances the toner particles removed at the cleaning station are returned to the development station for reuse. Apparatus for recycling used toner is disclosed, for example, in U.S. Pat. Nos. 3,660,863, 3,700,328, and 4,571,071, and in Item 17738 on page 37 of the January, 1979 edition of Research Disclosure, published by Kenneth Mason Publications Ltd., The Old Harbourmaster's, 8 North Street, Emsworth, Hampshire, P010 7DD, England. In the beforementioned U.S. Pat. No. 4,571,071, the recycling apparatus is disclosed for a color copier which is capable of applying toners of four different colors from four development stations to a photoconductor and recycling particles of each color toner back to the respective development station.

It also is known to remove residual toner particles from a photoconductor and deliver them to a container instead of recycling them. In this regard, see U.S. Pat. No. 4,082,061, for example. In the latter patent residual particles of toners of three different colors are removed from a photoconductor and delivered to three different collection bottles or containers.

In order to provide copies of a single color other than black, electrographic apparatus having a single development station that normally provides black toner particles to a photoconductor can be replaced with a similar development station having toner particles of a different color, for example red, green, blue, brown, etc. Developer particles of colors other than black can be used to print single color images on copy sheets, or can be used as an accent color on copy sheets on which black images also are produced during another run through the electrographic apparatus. If the electrographic apparatus has a system for recycling previously used toner particles removed at the cleaning station, then the recycling apparatus can contaminate the development stations by recycling some of the toner of one color (e.g. black) into a development station containing toner of a different color (e.g. red). At the same time, since the electrographic apparatus probably will be used primarily for producing black images, it is desirable to continue to recycle used black toner particles to the development station during long runs when black toner is being used.

SUMMARY OF THE INVENTION

It is an object of the present invention to provide electrographic apparatus with the advantages of a toner recycling system and also avoid contamination of interchangeable development stations containing toner particles of different colors.

The present invention is usable with electrographic apparatus having a photoconductor on which a latent image can be formed, and a development station for providing particles of toner to the photoconductor for developing the latent image. A cleaning station is provided for removing residual particles of used toner from the photoconductor. The improvement of the invention comprises a container for receiving particles of used toner from the cleaning station. A tube has a first end portion connected to the development station and a second end portion connected to the container. Used toner particles from the cleaning station are provided to an intermediate portion of the tube. An auger in the tube moves toner through the tube. Drive means coupled to the auger rotates the auger in a first direction for returning used toner particles to the development station and for rotating the auger in a second direction for feeding used toner particles to the container.

BRIEF DESCRIPTION OF THE DRAWINGS

In the detailed description of the preferred embodiment of the invention presented below, reference is made to the accompanying drawings, in which.

DETAILED DESCRIPTION OF A PREFERRED EMBODIMENT

Figure 1:
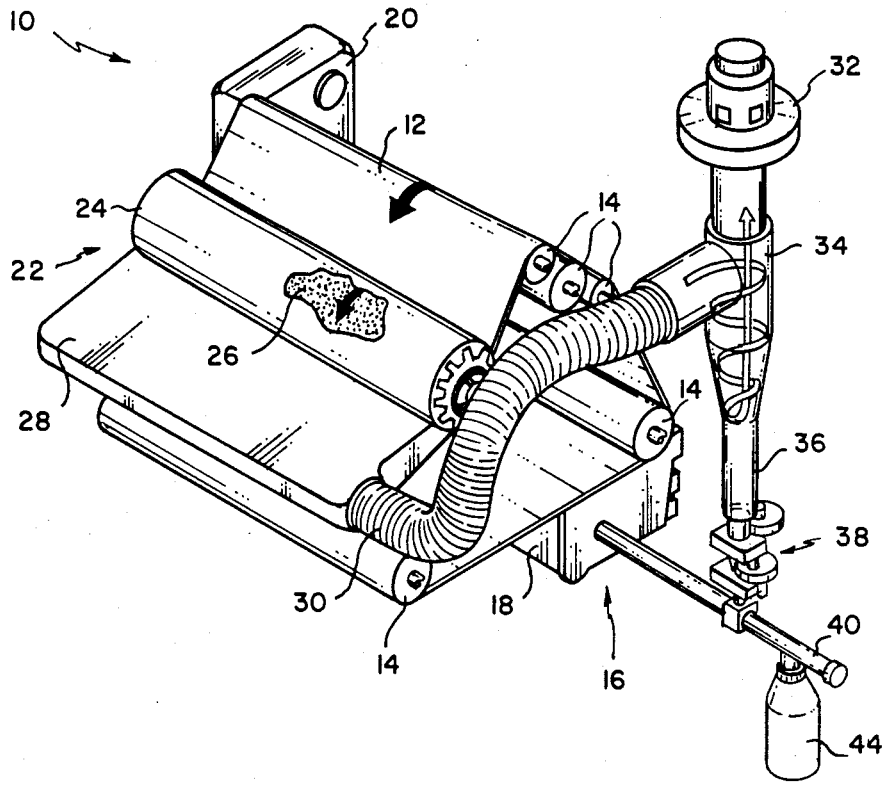
FIG. 1 is a perspective view of electrographic apparatus incorporating the present invention.

Referring now to FIG. 1 of the drawings, a fragmentary portion of an electrographic apparatus is generally designated 10 and may, for example, comprise part of a copier/duplicator. The apparatus 10 has an endless photoconductor 12 that is trained about a plurality of rollers 14, at least one of which is driven to move the photoconductor in a generally counterclockwise direction as shown by the arrow in FIG. 1. As known in the electrographic arts, the photoconductor is moved past a plurality of stations at which latent images are formed on the photoconductor, developed, transferred and fused to copy sheets. Then the photoconductor is cleaned and the cycle is repeated again. Only those stations related to the present invention are illustrated in detail in the drawings.

After a latent image is formed on the photoconductor, it is driven past a development station generally shown at 16 where the latent image is developed by developer material. More specifically, station 16 includes a housing 18 which holds developer material comprising, for example, carrier particles and toner particles. The developer mix is brought into contact with, or adjacent to, the surface of the photoconductor so that the toner particles can be transferred to a latent image to develop the image. Because some of the toner is thus depleted from the development station 16, it is necessary to introduce a fresh supply of toner into the station. This can be accomplished by means of a supply bottle or container 20 which is connected to the left end of the station, as viewed in FIG. 1, such left end being the front of the development station in the electrographic apparatus.

After the developed image has been transferred to a copy sheet for fusing the image thereto, some residual toner particles remain on the photoconductor 12 and need to be removed therefrom prior to the next cycle of operation in order to maintain high quality reproduction of images. The photoconductor is cleaned of residual toner particles in a cleaning station generally designated 22. Station 22 includes a generally cylindrical housing 24 enclosing a brush 26. The brush engages the photoconductor across its width and rotates in a direction opposite to the direction of movement of the photoconductor through the cleaning station to thereby clean the photoconductor of residual toner particles.

A vacuum hood 28 extends from the housing 24. A flexible conduit 30 has one end portion connected to the hood 28 and the other end portion is in communication with the inlet opening of a blower 32.

Upon operation of the blower suction is applied through the conduit 30 and hood 28 to create a vacuum in the housing 24. The vacuum withdraws toner particles removed from the photoconductor by the brush and moves them through the conduit and toward the blower 32. In this manner the toner particles are delivered to a cyclone separator 34 where the toner and air mixture is spiraled around the separator and centrifugal force propels the toner particles to the outer wall of the separator.

As air is drawn out of the separator by the blower 32, the toner particles move downwardly into a tube 36 and pass through an airlock 38. The airlock is necessary in order to maintain vacuum in the separator. The airlock may comprise, for exmple, a pair of cam operated pinch valves located in vertically spaced relation along the tube and operated sequentially so that the top cam is moved to open the tube and allow toner to drop past the first cam and then the first cam is closed and the lower cam opens the tube to allow toner between the cams to pass the second cam and drop through the bottom of the tube. A cam operated airlock of this type is disclosed in the beforementioned Research Disclosure publication item 17738. As explained in the Research Disclosure publication, the toner particles passing through the airlock can be driven by an auger back to the development station 16 for use in developing other latent images on the photoconductor.

Figure 2:
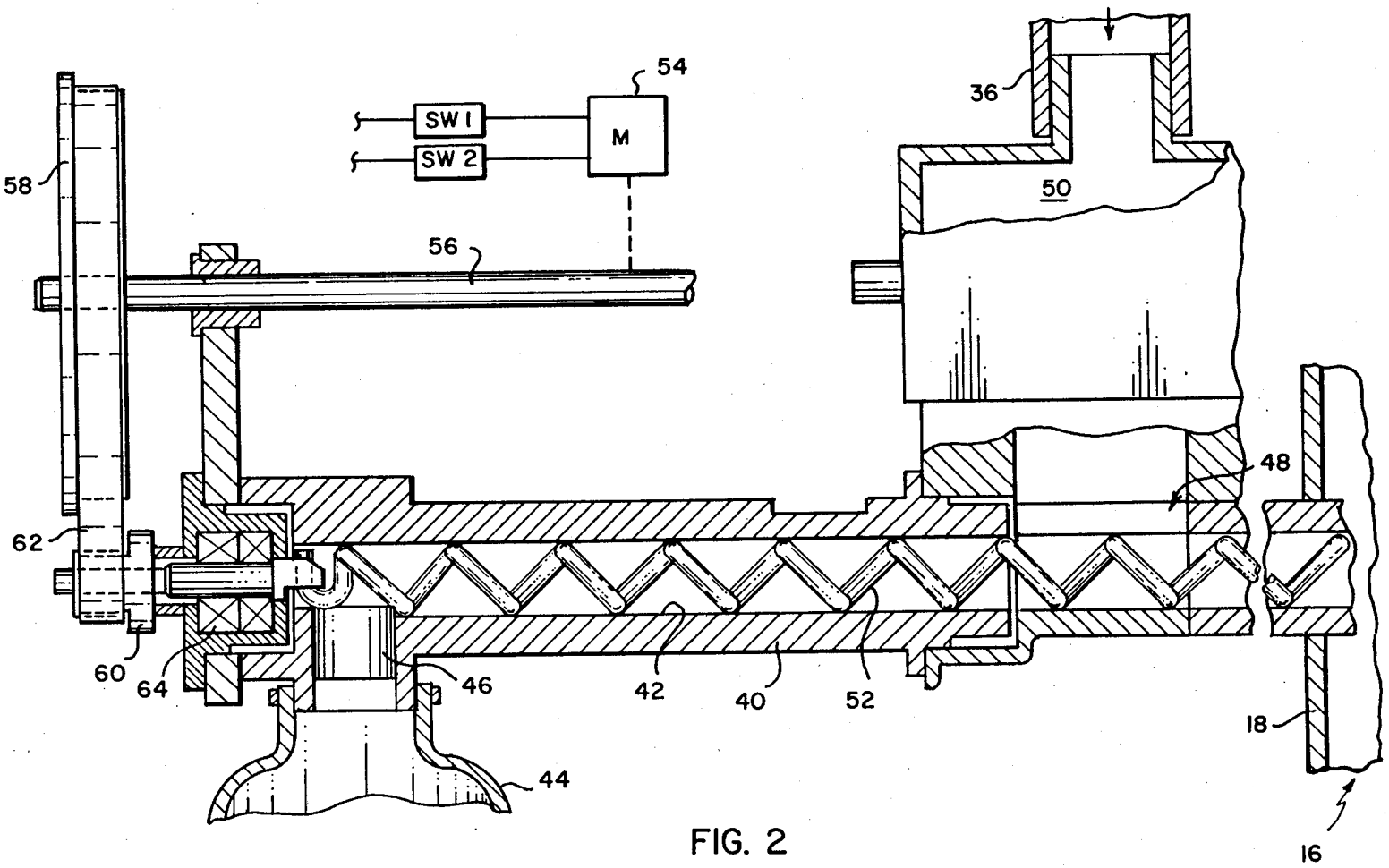
FIG. 2 is an enlarged detail cross section view of a portion of the FIG. 1 apparatus.

Referring now to FIG. 2 of the drawings, an elongate generally cylindrical tube 40 is located beneath the lower end of the tube 36. Tube 40 can be made in sections, as illustrated in the drawings, or from a single piece of tubing. Tube 40 has an elongate cylindrical continuous passageway 42 extending the full length of the tube. The right end portion of tube 40 projects through the housing 18 of development station 16 so that used toner received in the passageway 42 can be returned to the sump of the development station for reuse.

A container 44 receives particles of used toner from the cleaning station that are not to be recirculated through the development station. The end portion of tube 40 opposite from the development station has an opening 46 that communicates with passageway 42. Container 44 is connected to the tube 40 so that the open upper end of the container is in communication with the opening 46 to allow used toner to pass through passageway 42 and opening 46 into the container 44.

Tube 40 has another opening 48 at the top of an intermediate portion of the tube for receiving used toner from the lower end of tube 36. The tube 36 is connected to opening 48 through a passage 50.

An auger 52 is located in passageway 42 of the tube 40 for moving toner through the passageway. The auger is driven from a reversible motor 54 that is coupled to a shaft 56. A drive pulley 58 is mounted on shaft 56 drives a similar pulley 60 through a belt 62. Pulley 60, in turn, is connected to the auger 52 by a coupling 64. Thus reversible motor 54 is effective to drive the auger 52 in either first or second opposite directions about its axis. When driven in one direction the auger moves used toner particles in passageway 42 to the right as viewed in FIG. 2 to return them to the development station 16. When the auger is driven in the opposite direction, toner particles are driven to the left where they are discharged through opening 46 into the container 44.

While the apparatus of the invention could be used for alternately providing used toner of a single color either to the development station 16 or to the container 44, it is especially desirable for use with electrographic apparatus as described previously which uses two interchangeable development stations to alternately apply either toner of a single color, such as black, or a second single color, such as red, green, etc., to the photoconductor for developing latent images. When two color toner particles are being applied from each of two interchangeable development stations, it may, for example, be desirable to recycle or recirculate toner of one color, such as black, from the cleaning apparatus 22 back to the development station 16 for reuse, and deliver toner particles of any other color to the container 44 for disposal. This will prevent contamination of black toner in the black development station. Alternately, black toner could be delivered to container 44 and toner of another color could be recycled to the sump of a development station.

Control means for assuring recirculation of toner particles of one color and collection of toner particles of other colors in the container 44 can take various forms. For example, as shown in FIG. 2 of the drawings, two switches SW1 and SW2 can be provided for controlling motor 54. When switch SW1 is closed the motor 54 rotates auger 52 in a direction to drive used toner particles into the station 16. On the other hand, when switch SW2 is closed the motor 54 rotates the auger 52 in the opposite direction for delivering used toner particles to container 44.

The switches could be manually actuated by the operator each time the development station is changed, however it is preferred to close the switches automatically and thus avoid a possible operator error which could lead to contamination. The switches can be automatically closed as a function of loading a development station into the electrographic apparatus. For example, one of the switches can be closed by connection of a plug and socket for making the required electrical connections between a development station and the other electrographic apparatus. Also the switches can be closed by sensing a code notch or other inditia on the development station 16 or the cartridge 20 for supplying fresh toner to the station. Such sensing can automatically determine the color of the toner prticles in the development station. The switches SW1 and SW2 can be connected directly to the motor 54 as shown in FIG. 2, or can provide a signal to the logic and control unit of the associated electrographic copier/duplicator which, through the associated software, will operate the motor to turn the auger in the desired direction.

By using the logic and control unit to control motor 54, another desirable mode of operation is possible. Thus when a first development station is replaced with a second development station having toner particles of a different color, the logic and control unit can switch the motor to drive the auger in a direction to feed recovered toner particles to container 44 until a specific number of copies (e.g. fifty copies) have been made with the toner in the second development station. Then the logic and control unit can reverse the direction of rotation of the motor and auger to feed recovered toner back to the second development station. The number of copies made before reversing the motor should be sufficient to purge from the photoconductor and cleaning system substantially all toner particles from the first development station.

While the invention has been described in detail with particular reference to a preferred embodiment thereof, it will be understood that variations and modifications can be effected within the spirit and scope of the invention.

I claim:

1. In electrographic apparatus having a photoconductor on which latent images can be formed, first and second interchangeable development stations for providing particles of toner of first and second colors to the photoconductor for developing the latent images, a cleaning station for removing residual particles of used toner from the photoconductor, the improvement comprises:

a container for receiving particles of used toner from the cleaning station, a tube having a first end portion connected to the development station and a second end portion connected to the container, means for providing used toner particles from the cleaning station to an intermediate portion of the tube, an auger in the tube for moving toner through the tube, drive means coupled to the auger (1) for rotating the auger in a first direction for returning used toner particles to the development station and (2) for rotating the auger in a second direction for feeding used toner particles to the container, and control means responsive to the presense of the first development station to operate the drive means to rotate the auger in its first direction, and the control means being responsive to the presence of the second development station to operate the drive means to rotate the auger in its second direction.

2. In electrographic apparatus having a photoconductor on which a latent image can be formed, interchangeable development stations for providing particles of toner of a first color and a second color to the photoconductor for developing the latent image, a cleaning station for removing residual particles of used toner from the photoconductor, the improvement comprises:

a container for receiving particles of used toner from the cleaning station, a tube having a first end portion connected to the development station and a second end portion connected to the container, means for providing used toner particles from the cleaning station to an intermediate portion of the tube, an auger in the tube for moving toner through the tube, and drive means coupled to the auger (1) for rotating the auger in a first direction for returning used toner particles to the development station and (2) for rotating the auger in a second direction for feeding used toner particles to the container, and control means for the drive means, the control means comprising means for determining if toner particles of the first color or the second color are being used to develop latent images, and the control means being effective to operate the drive means to rotate the auger in its first direction when toner particles of the first color are being used to develop images, and the control means being effective to operate the drive means to rotate the auger in its second direction when toner particles of the second color are being used to develop images.

* * * * *